US006948798B2

(12) United States Patent
Kline et al.

(10) Patent No.: US 6,948,798 B2
(45) **Date of Patent: *Sep. 27, 2005**

(54) METHOD AND APPARATUS FOR HORIZONTALLY LOADING AND UNLOADING AN INK-JET PRINT CARTRIDGE FROM A CARRIAGE

(75) Inventors: Daniel S Kline, Encinitas, CA (US); Ram Santhanam, San Diego, CA (US); Junji Yamamoto, San Diego, CA (US); Chee Meng Chen, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 204 days.

This patent is subject to a terminal disclaimer.

(21) Appl. No.: 10/263,138

(22) Filed: Oct. 1, 2002

(65) Prior Publication Data

US 2003/0169318 A1 Sep. 11, 2003

Related U.S. Application Data

(63) Continuation of application No. 09/872,959, filed on May 31, 2001, now Pat. No. 6,471,334.

(51) Int. Cl.[7] ..... B41J 2/01
(52) U.S. Cl. ..... 347/49
(58) Field of Search ..... 347/37, 45, 86, 347/87

(56) References Cited

U.S. PATENT DOCUMENTS 4,755,836 A * 7/1988 Ta et al. ..... 347/49
4,771,295 A 9/1988 Coverstone et al.
4,872,026 A * 10/1989 Rasmussen et al. ..... 347/56
4,907,018 A * 3/1990 Pinkerpell et al. ..... 346/139 R
5,392,063 A * 2/1995 Rhoads ..... 347/49
5,561,450 A * 10/1996 Brewster et al. ..... 347/49
5,815,183 A * 9/1998 Sasaki ..... 347/86
5,825,388 A * 10/1998 Sasaki ..... 347/86
5,949,459 A * 9/1999 Gasvoda et al. ..... 347/86
6,070,974 A * 6/2000 Kotaki et al. ..... 347/86
6,142,600 A * 11/2000 Takahashi et al. ..... 347/23
6,155,678 A * 12/2000 Komplin et al. ..... 347/86
6,296,345 B1 * 10/2001 Kline et al. ..... 347/49
6,471,334 B2 * 10/2002 Kline et al. ..... 347/49

FOREIGN PATENT DOCUMENTS

EP 0 519 457 12/1992
EP 0 604 940 7/1994
EP 0 610 965 8/1994

OTHER PUBLICATIONS

Copy of International Search Report having European Application No. 04077231.1 mailed on Feb. 10, 2005.

* cited by examiner

*Primary Examiner*—Anh T. N. Vo

(57) ABSTRACT

An apparatus for horizontally loading and unloading an ink-jet print cartridge from a carriage in a printer. The apparatus includes a generally rectangular print cartridge, an elongate supporting lip located on a side wall of the print cartridge, a carriage body, a chute mounted on the carriage for receiving the print cartridge, and a generally horizontal rail on a side wall of the chute for guiding the print cartridge into the carriage. In operation, the apparatus horizontally loads a print cartridge into a carriage by translating the print cartridge horizontally forward into a carriage, engaging a lip on the print cartridge with a guide rail on the carriage, sliding the print cartridge up and over a datum on the carriage with the guide rail and latching the print cartridge in the carriage. The apparatus unloads a print cartridge from a carriage by rotating the print cartridge about a datum on the carriage, unlatching the print cartridge from the carriage, and horizontally translating the print cartridge out of the carriage.

21 Claims, 16 Drawing Sheets

METHOD AND APPARATUS FOR HORIZONTALLY LOADING AND UNLOADING AN INK-JET PRINT CARTRIDGE FROM A CARRIAGE

RELATED APPLICATIONS

This application is a Continuation of application Ser. No. 09/872,959, filed on May 31, 2001, now U.S. Pat. No. 6,471,334, which is a Continuation of application Ser. No. 09/477,649, filed on Jan. 5,2000, now U.S. Pat. No. 6,296, 345.

This application is related to the following copending utility patent applications, each filed concurrently on Jan. 5,2000:

Ser. No. 09/477,645 by Ram Santhanam et al., entitled "Vent For An Ink-Jet Print Cartridge";

Ser. No. 09/477,646 by Ram Santhanam et al., entitled"Ink-Jet Print Cartridge Having A Low Profile";

Ser. No. 09/477,644 by Junji Yamamoto et al., entitled-"Horizontally Loadable Carriage For An Ink-Jet Printer";

Ser. No. 09/478,148 by Richard A. Becker et al., entitled"Techniques For Providing Ink-Jet Cartridges With A Universal Body Structure";

Ser. No. 09/477,843 by Ram Santhanam et al., entitled"Techniques For Adapting A Small Form Factor Ink-Jet Cartridge For Use In A Carriage Sized For A Large Form Factor Cartridge";

Ser. No.09/478,190 by James M. Osmus, entitled"Printer With A Two Roller, Two Motor Paper Delivery System";

Ser. No. 09/477,860 by Keng Leong Ng, entitled"Low Height Inkjet Service Station";

Ser No. 09/477,648 by Matt Shepherd et al., entitled"New Method Of Propelling An Inkjet Printer Carriage";

Ser. No. 29/116,564 by Ram Santhanam et al., entitled"Ink Jet Print Cartridge"; and Ser. No. 09/477,940 by Ram Santhanam et al., entitled-"Multiple Bit Matrix Configuration For Key-Latched Printheads", all of which are incorporated by reference.

FIELD OF INVENTION

The present invention generally relates to ink-jet printers and, more particularly, to the components and subsystems therein.

BACKGROUND OF THE INVENTION

The general construction and operation of an ink-jet print cartridge using reticulated polyurethane foam is disclosed in U.S. Pat. No. 4,771,295 entitled "Thermal Ink Jet Pen Body Construction Having Improved Ink Storage and Feed Capacity" by Baker et al., issued 13 Sep. 1988.

The general design and construction of carriages that retain and align ink-jet print cartridges in printers and scan these print cartridges through print zones is well known. Examples of the patents that have issued in this field of technology include:

U.S. Pat. No. 4,755,836 entitled "Printhead Cartridge and Carriage Assembly" by Ta et al., issued 5 Jul. 1988

U.S. Pat. No. 4,872,026 entitled "Ink-jet Printer with Printhead Carriage Alignment Mechanism" by Rasmussen et al., issued 3 Oct. 1989

U.S. Pat. No. 4,907,018 entitled "Printhead-Carriage Alignment and Electrical Interconnect Lock-in Mechanism" by Pinkerpell issued 6 Mar. 1990

U.S. Pat. No. 5,392,063 entitled "Spring Cartridge Clamp for Inkjet Printer Carriage" by Rhoads issued 21 Feb. 1995.

Prior carriages have been designed to be loaded and unloaded either vertically or with a steep, inclined, arcuate motion. Such carriages have proven to be satisfactory as long as vertical to the printer is provided. This has meant, however, that nothing could be permanently stacked on top of the printer.

Further, previous top loading ink-jet printer designs have fostered an increasing growth in printer height so that with each new printer design, the profile of the product grew and grew.

Additionally, it is believed that end users want a printer for home use that can be stacked in an entertainment center or used in living rooms. This is a printer that has flat top and bottom walls, that is front loading with all controls and status indicators on the front wall, and that is about the same size as a conventional stereo amplifier or a video cassette recorder (VCR). In other words, this is a horizontally loadable ink-jet printer with an overall height of less than four inches (4").

Such requirements result in numerous design challenges. First, nearly all existing datum structures on present day ink-jet print cartridges are designed for vertical or near vertical installation. Front or horizontal loading has heretofore not been contemplated so if an existing datum structure is to be used, the print cartridge must be positioned in an entirely new manner. Second, on a front loading printer the field of view available to a user during cartridge installation is quite restricted. The user sees less of the carriage and less of the loading process. Third, physical access to the carriage is more limited. Fourth, if multiple print cartridges are used, they must sit so close together that much of their gripping surfaces is unavailable for unloading the print cartridge from the printer.

Thus, it is apparent from the foregoing that although there are many different carriage designs, designing a front loading, stackable, low height ink-jet printer presents many challenges.

SUMMARY OF THE INVENTION

Briefly and in general terms, an apparatus according to the invention includes a generally rectangular print cartridge, an elongate supporting lip located on a side wall of the print cartridge, a carriage body, a chute mounted on the carriage for receiving the print cartridge, and a generally horizontal rail on a side wall of the chute for guiding the print cartridge into the carriage.

In operation, the apparatus horizontally loads a print cartridge into a carriage by translating the print cartridge horizontally forward into a carriage, engaging a lip on the print cartridge with a guide rail on the carriage, sliding the print cartridge up and over a datum on the carriage with the guide rail and latching the print cartridge in the carriage. The apparatus unloads a print cartridge from a carriage by rotating the print cartridge about a datum on the carriage, unlatching the print cartridge from the carriage, and horizontally translating the print cartridge out of the carriage.

Other aspects and advantages of the invention will become apparent from the following detailed description, taken in conjunction with the accompanying drawings, illustrating by way of example the principles of the invention.

DESCRIPTION OF THE PREFERRED EMBODIMENTS

Figure 1:
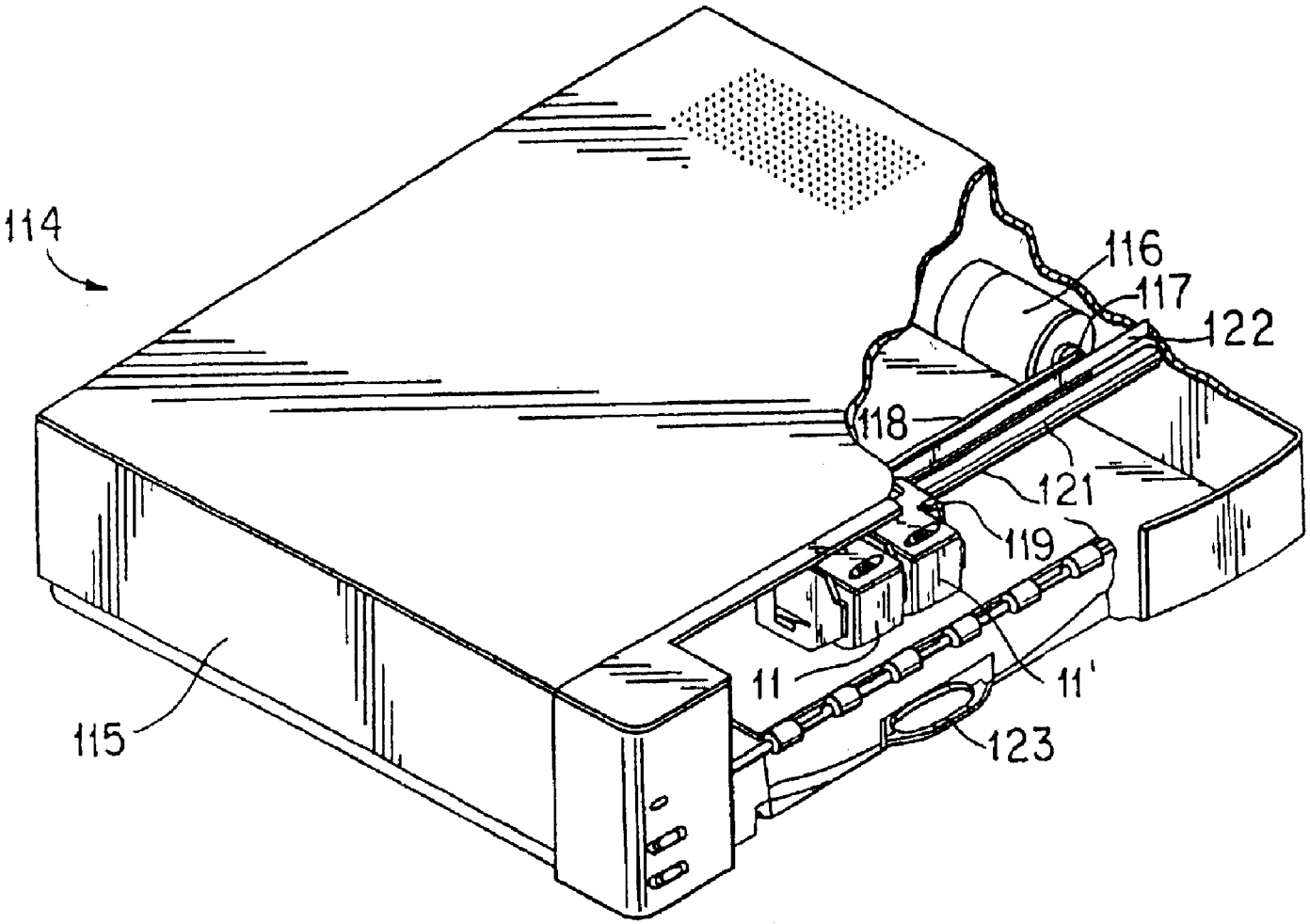
FIG. 1 is a perspective view, in section and partially cut away, of an ink-jet printer embodying the principles of the invention.

As shown in the drawings for the purposes of illustration, the invention is embodied in a front loading, stackable, low height, ink-jet printer.

The apparatus offers a simple, inexpensive solution, easy self-evident operation, and leverages the datum structure from a print cartridge currently in production.

The Printer

Referring to FIG. 1, reference numeral 114 generally indicates an ink-jet printer partially cut away and with its front loading door removed. The printer includes a case part 115 and a DC drive motor 116 mounted on a chassis. Mounted on the shaft of the motor 116 is a pulley 117 drives a belt 118 back and forth as the drive motor reverses in direction. The drive belt 118 is attached to a carriage 119 that scans laterally back and forth from left to right and right to left. The carriage 119 contains two thermal ink-jet print cartridges 11, 11' located side by side. Print cartridge 11 contains black ink, and print cartridge 11' has three ink chambers containing magenta, yellow and cyan inks. The horizontal scanning motion of the carriage is guided by a slide rod 121. Located in the rear of the carriage 119 is an encoder, not shown, that reads an encoder strip 122 that enables the electronic circuits in the printer to locate the carriage 119 along its scanning path. After the printer 114 prints a sheet of media, the media is ejected into an output tray on which a handle 123 is mounted.

The Print Cartridge

Referring to FIGS. 2–8, reference numeral 11 generally indicates a low profile ink-jet print cartridge for a printer. The low profile cartridge 11 of the present invention allows printer 114 to be relatively shorter and narrower than its predecessors while still retaining a relatively high ink containing capacity in cartridge 11. Cartridge 11 and printer 114 are together adapted to allow for a horizontal loading of the cartridge 11. This allows electronics and other items to be stacked on top of printer 114 even when cartridge 11 is being replaced. Enabling stackable and shorter printing systems allows such printing systems to enter new applications such as home printing appliances that have critical stackability and space constraints.

In the embodiment actually planned for production, the print cartridge is about forty-seven millimeters (47 mm) high, the printer is less than four inches (4") tall, and the cartridge contains at least seventeen cubic centimeters (17 cc) of ink.

The print cartridge includes a print cartridge body 12 that is generally rectangular in shape with a front wall 24, a left side wall 25, a right side wall 26, and a back wall 27. The low profile body 12 has three orthongonal axes defined by the walls, including a major axis or an axis of elongation (depth) between the front and back walls. This elongate dimension allows the cartridge to house more ink while not impacting the printing system height (affected by the height of the cartridge) or the system width (affected by the spacing between the left and right side walls).

Figure 2:
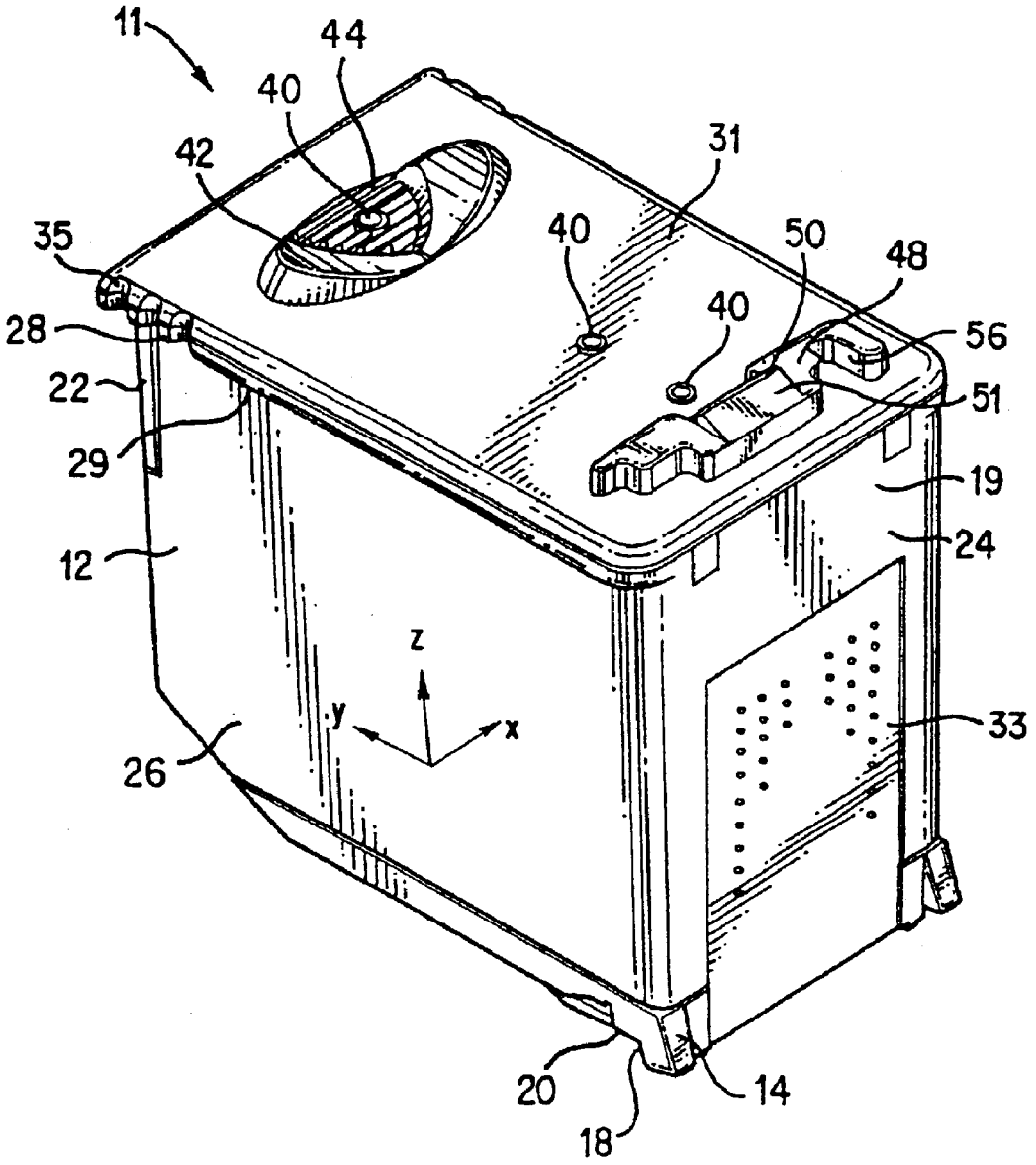
FIG. 2 is a perspective view, of the ink-jet print cartridge of FIG. 1.

The cartridge 11 has a user or back portion generally indicated by reference numeral 28, FIG. 2, including the back wall 27 that is intended for the user to handle or grab during installation of the cartridge 11 into a printing system. The user portion includes user-friendly ergonomic features (such as gripping features 35) discussed in more detail below.

Figure 5:
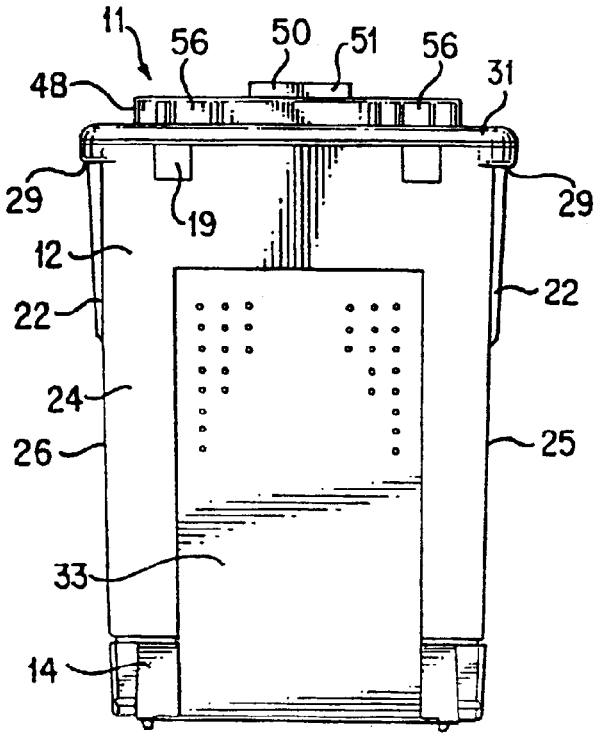
FIG. 5 is a front side elevational view of the print cartridge of FIG. 2.
Figure 7:
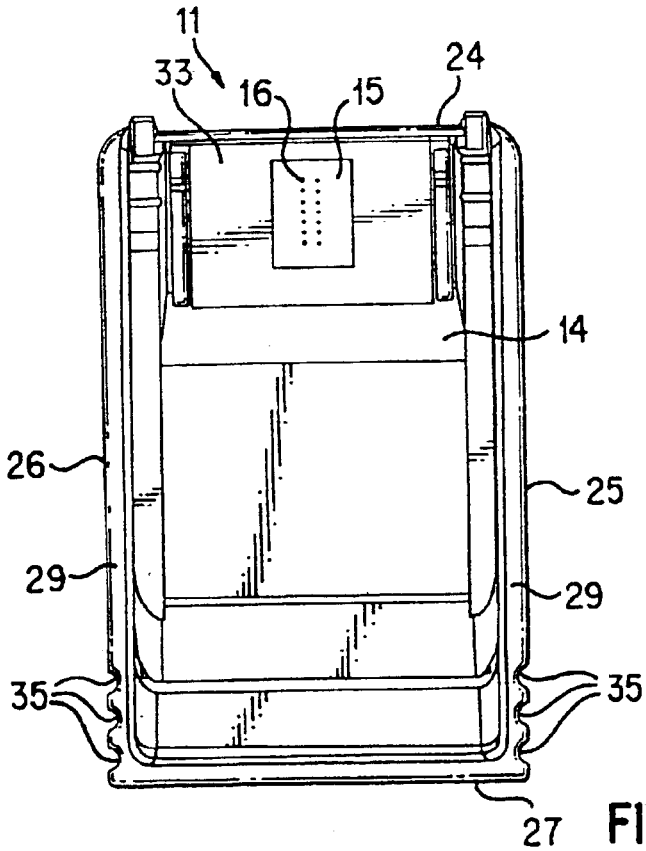
FIG. 7 is a bottom plan view of the print cartridge of FIG. 2.

Cartridge 11 includes an electrical connection or front portion 30, FIGS. 2, 5, and 7 including front wall 24 that includes a plurality of electrical contacts disposed upon a circuit 33 for conducting electrical signals from the printing system for energizing the cartridge 11. These contacts are preferably located as far from the user portion 28 as possible to prevent a user from contaminating the contacts on circuit 33 with, for example, fingerprints. Having the axis of elongation between the front and back walls enhances this aspect.

Cartridge 11 includes a top wall 31 positioned in connecting relationship between the back wall 27 and the front wall 24. In a preferred embodiment, the top wall 31 is a lid 31. The top wall 31 joins the side, front, and back walls along side, front, and back margins, respectively. Included on the top wall is a latch feature 50 that is spaced away from the front margin.

In one embodiment, the print cartridge body houses three ink chambers for holding inks of the various hues, black, cyan, magenta, and yellow. The ink chambers are filled with reticulated polyurethane foam. The foam is compressed to maintain the back pressure of the ink at the print head 15, FIG. 7. In the bottom of each chamber is a stand pipe and filter of conventional construction to insure that particles do not clog the nozzles. A second embodiment of print cartridge 11 houses a single chamber for carrying black ink.

Figure 3:
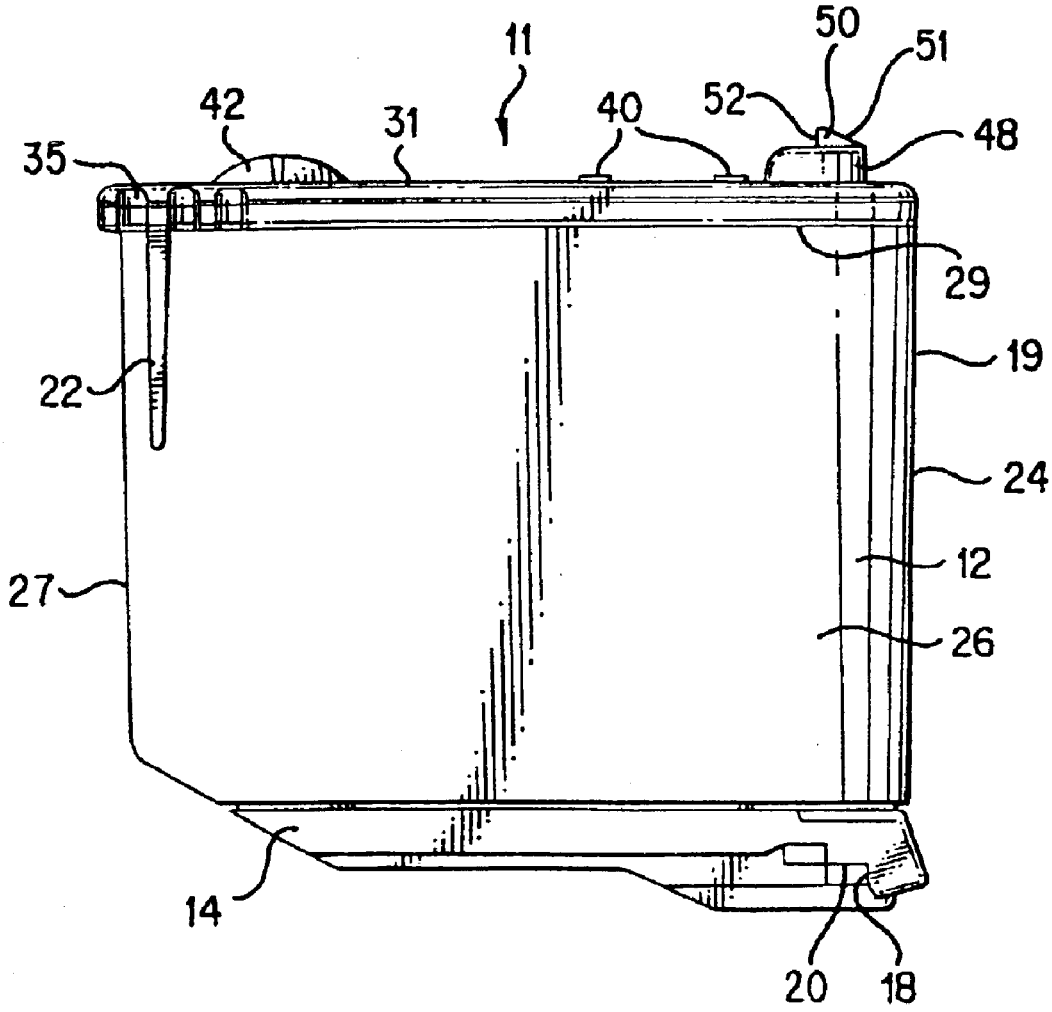
FIG. 3 is a right side elevational view of the print cartridge of FIG. 2.
Figure 4:
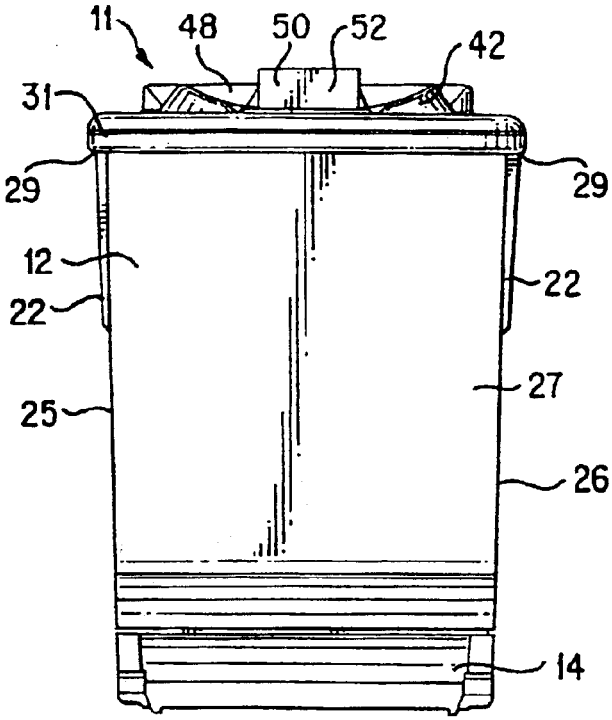
FIG. 4 is a back side elevational view of the print cartridge of FIG. 2.
Figure 6:
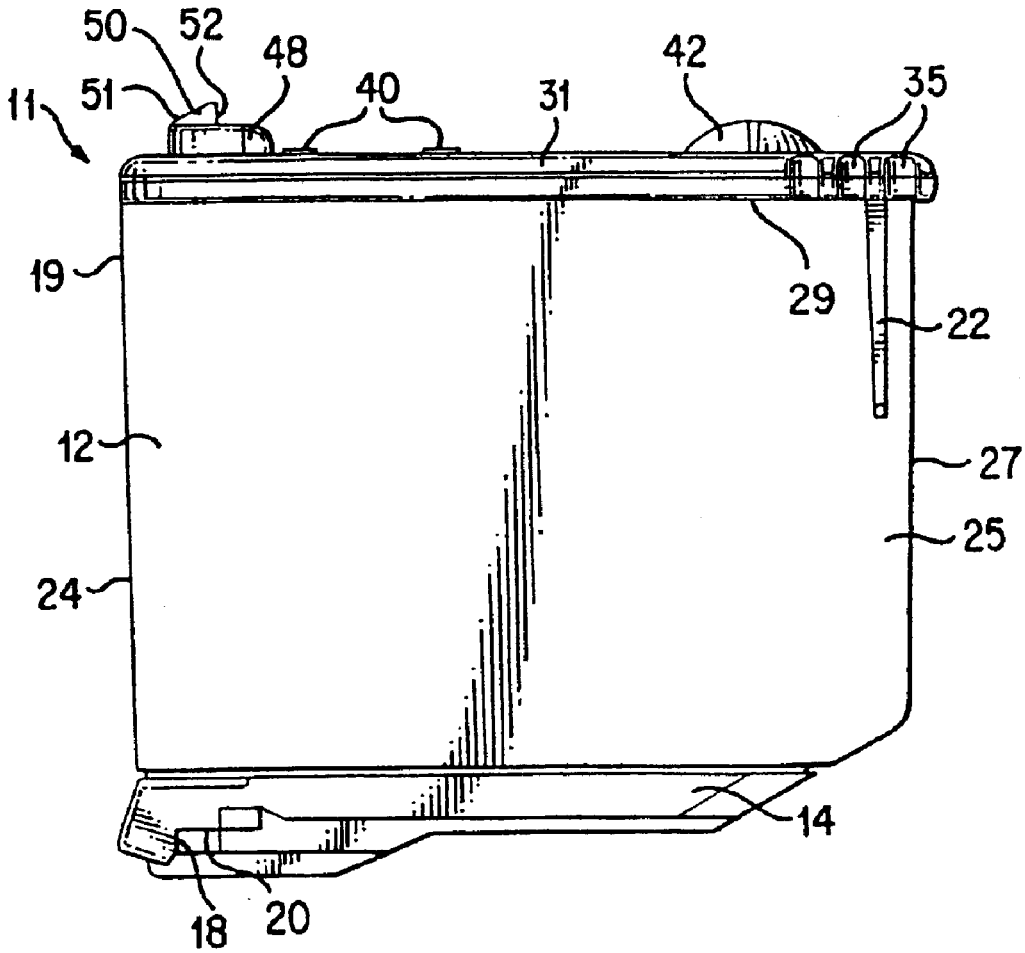
FIG. 6 is a left side elevational view of the print cartridge of FIG. 2.

The print cartridge body 12 also includes a nose piece 14 that is ultrasonically welded to the body. The nose piece contains three channels that each connect to a stand pipe in one of the ink chambers. The channels direct the ink from the chambers to one of three series of nozzles 16, FIG. 7, on the print head 15. Located on the nose piece 14, FIGS. 3 and 6, are an X axis datum 18 and an Z axis datum 20. These datums are holding points and are leveraged from a print cartridge currently in production. The Y axis datum 19, FIG. 2, is the front wall 24 of the print cartridge and is a stop point. The X and Z datums 18, 20 mate with corresponding datums 152, 154, FIGS. 12 and 13 on the carriage 119, FIG. 9, and align the print cartridge 11 in the carriage, as explained in detail below.

Referring to FIGS. 2, 3, and 6, reference numeral 22 generally indicates two ribs that serve as gripping surfaces when the print cartridge 11 is removed from the printer. Each rib is located vertically on one of the side walls 25, 26, along the common margins between the side walls 25 and 26 and the back wall 27 of the print cartridge body 12.

Referring to FIGS. 2, 3, 4, 5, and 6, reference numeral 29 generally indicates an elongate supporting lip located on the two side walls 25, 26 and the back wall 27 of the print cartridge body 12. The lip is located along the margin between the print cartridge body 12 and the lid 31, described in detail below. The portions of the lip 29 located on the side walls 25, 26, FIGS. 4 and 5, support and guide the print cartridge during loading and unloading from a printer. These portions of the lip engage a pair of corresponding guide rails 140, FIGS. 10, 12, and 13, or loading ramps on the carriage 119 of the printer.

Also located on the print cartridge body 12, FIGS. 2 and 5, is a flex circuit 33 of conventional construction. The flex circuit provides the electrical inter-connection between the printer and the print head 15, FIG. 7, and routes electrical energy to the appropriate firing resistors during printing.

Figure 8:
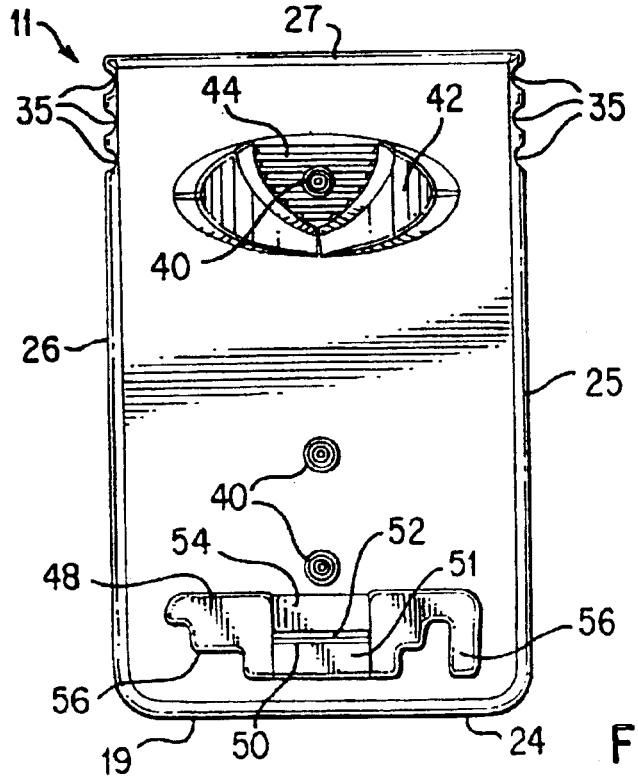
FIG. 8 is a top plan view of the print cartridge of FIG. 2.

Referring to FIGS. 2 and 8, reference numeral 35 indicates a plurality of gripping groves located along the margin between the lid 31, described in detail below, and the side walls 25, 26 of the print cartridge body 12. The gripping groves serve as a gripping surface on the print cartridge 11 from removing the print cartridge from a printer once the print cartridge has been unlatched from the carriage. The gripping groves also serve as a visual indication with respect to any adjacent print cartridges that the associated print cartridge has been unlatched from the carriage.

Referring to FIGS. 2, 3, 4, 5, and 6, reference numeral 31 generally indicates a lid having a planer outside surface. The plane of the outside surface of the lid is also parallel to the supporting lip 29. The lid 31 is ultrasonically welded to the print cartridge body 12 along the margin of the side walls 25 and 26, the front wall 24, and the back wall 27. The lid seals the ink in the ink reservoir chambers within the print cartridge body 12. The lid also contains three vents 40, FIGS. 2 and 8 that allow air at atmospheric pressure to enter each of the reservoir chambers.

Located on the lid 31, FIGS. 2 and 8, proximate to the margin between the back wall 27 and the lid is a button-like structure 42. In the top plan view of the print cartridge 11, FIG. 8, this structure has an elliptical shape. In the back side elevational view, FIG. 4, this structure has an outward opening, circular shape. In the side elevational views, FIGS. 3 and 6, this structure has the shape of a chord of a circle. The middle of this structure is flush with the outside surface of the lid 31 and contains a plurality of groves 44. The groves act as a gripping surface for the user. This structure has this unique shape to indicate to the user where to push the print cartridge down to unlatch the cartridge from the carriage of a printer. Such downward motion releases the print cartridge from the latch spring 148, FIG. 11, on the carriage 119, FIG. 9.

Referring to FIGS. 2 and 8, reference numeral 48 generally indicates an island located on the top surface of the lid 31 and displaced away from the margin between the lid 31 and the front wall 24 of the print cartridge body 12. The island 48 includes a latch 50 for securing the print cartridge 11 within a printer carriage. Referring to FIGS. 2, 3, and 6, the latch 50 is located on the lid 31 and not on the front wall 24 so that the print cartridge can be manufactured with existing equipment and without requiring new tooling. As illustrated in FIGS. 2, 3, and 6, the latch has a triangular cross section formed by a latch ramp 51 and a latch wall 52. The latch ramp 51 has three functions: to gradually increase the installing or latching force that must be exerted by the user when installing the print cartridge 11 in a printer; to ease the opening of the latch spring during installation; and to continuously force the print cartridge 11 out of the printer until the print cartridge is precisely seated in the carriage. This latter feature prevents "false latching" of the print cartridge. The latch wall 52 is located perpendicular to the outside surface of the lid 31 and is the surface engaged by the latch spring when the print cartridge is precisely seated in the carriage of the printer.

The island 48, FIG. 8, further includes a latch well 54 located behind the latch wall 52. The latch well is a relieved area in the lid 31 that permits the latch spring 148, FIG. 11, to travel below the outside surface of the lid as necessary to maintain a constant latching force during the life of the printer. The island 48 also has two sets of keys 56 located on either side of the latch 50 that identify the print cartridge 11 to the printer.

While the print cartridge described above contains three ink reservoirs and three vents 40, FIGS. 2 and 8, it is contemplated that a print cartridge with one or more reservoirs with one or more vents can also be used. In the printer 114, FIG. 1, that is planned for this print cartridge, one print cartridge 11 having one reservoir containing only black ink will be installed adjacent to a second print cartridge 11' having three reservoirs containing the three primary hues.

Further, it is contemplated that a print cartridge can be used that does not require a lid 31 as described above. Such a cartridge would need only a top wall with the appropriate vent(s) that seals the one or more reservoirs.

The Carriage

Figure 9:
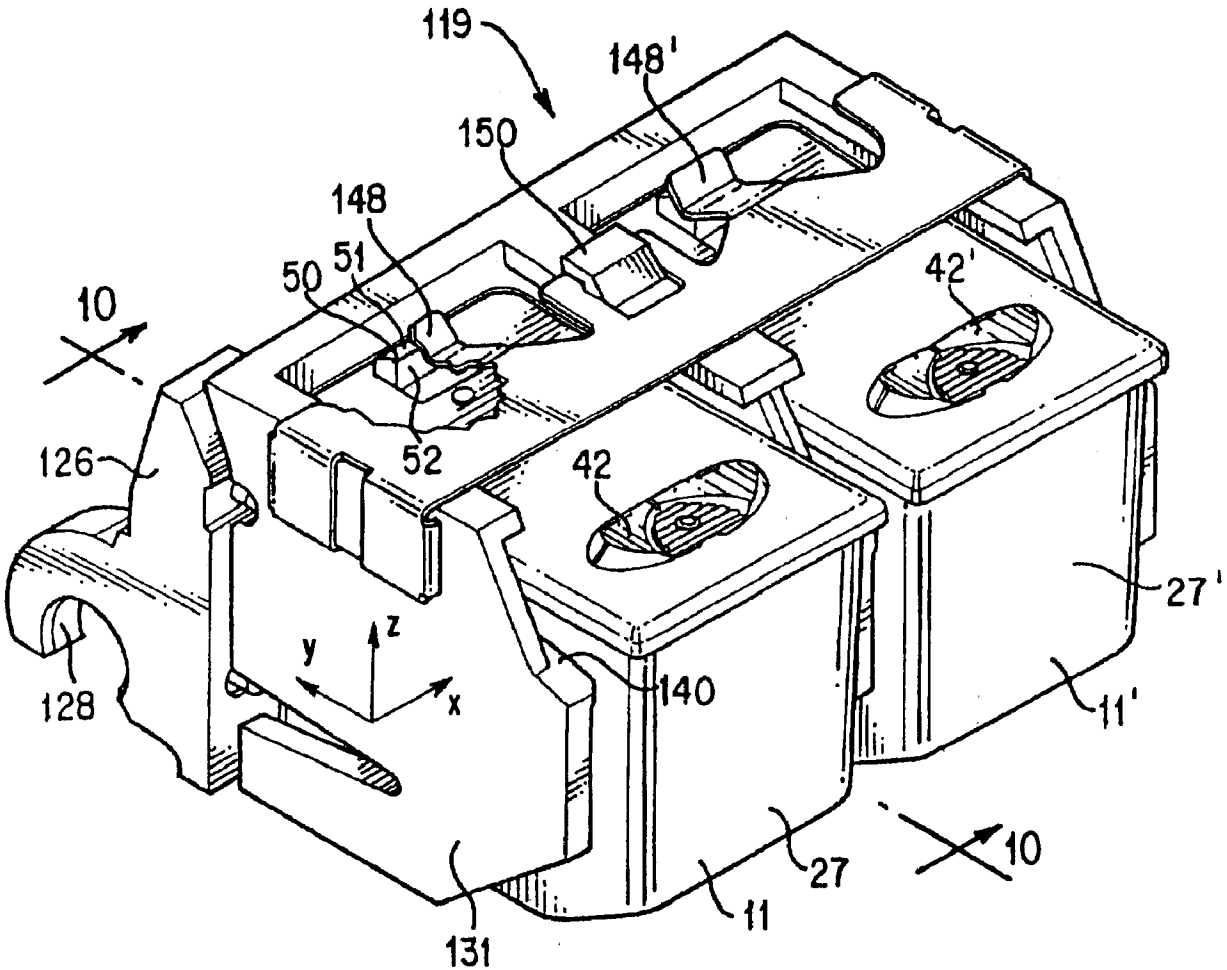
FIG. 9 is a perspective view, in section and partially cut away of the carriage and the ink-jet print cartridges of the ink-jet printer of FIG. 1.

In FIG. 9, the "X" axis is parallel with the longitudinal axis of the slide rod 121, FIG. 1. The "Y" axis is pointed to the rear and into the printer 114, FIG. 1, and is in the reverse direction to the path of the paper through the print zone. The "Z" axis is pointing vertically upward.

Figure 14:
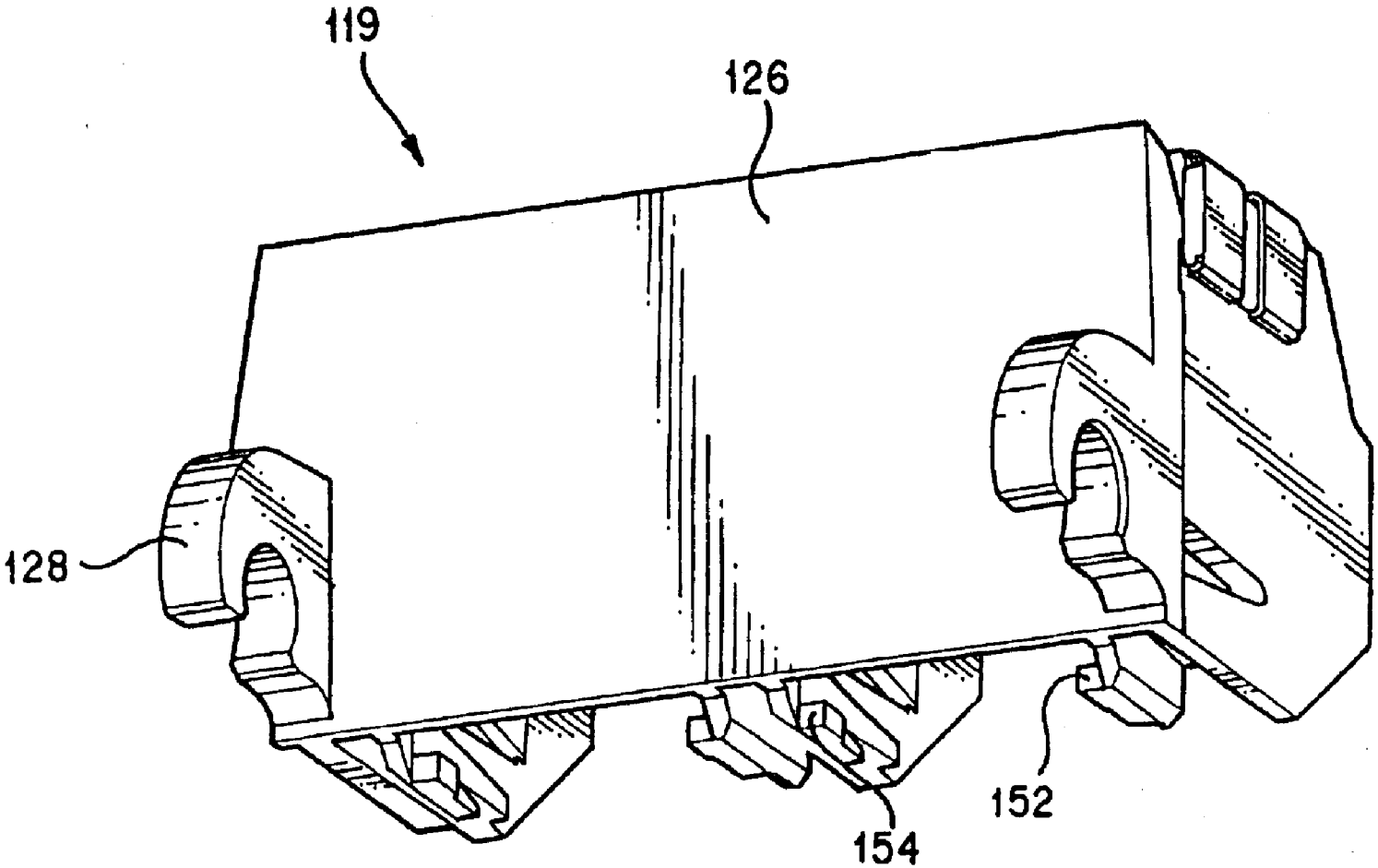
FIG. 14 is a rear perspective view of the carriage of FIG. 9, with the print cartridges removed.

Referring now particularly to FIGS. 9 and 14, the carriage 119 includes a carriage base 126 that supports the structure. The carriage base has two "C" shaped arch supports 128 located at its ends. These arch supports provide bearing support and engage the slide rod 121, FIG. 1.

Figure 12:
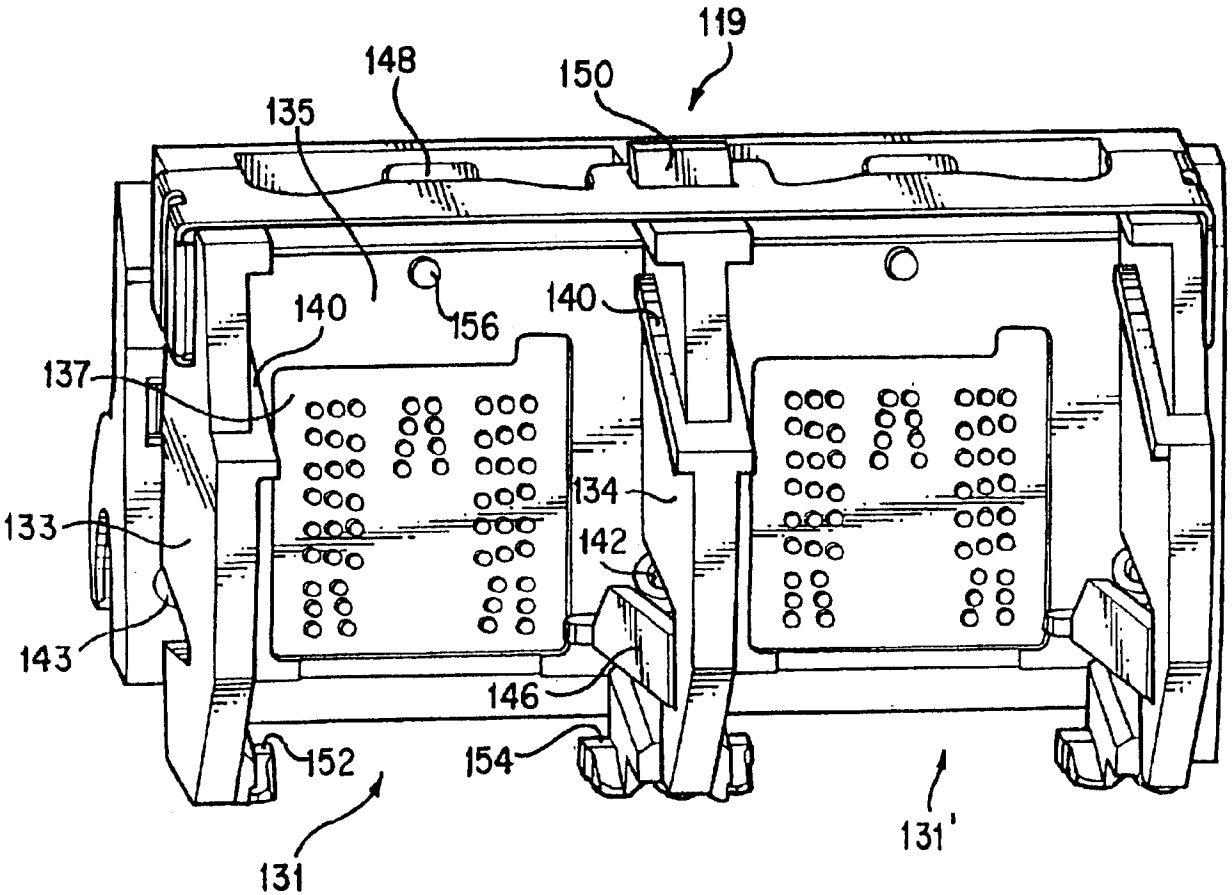
FIGS. 12 and 13 are front perspective views of the carriage of FIG. 9, with the print cartridges removed.
Figure 13:
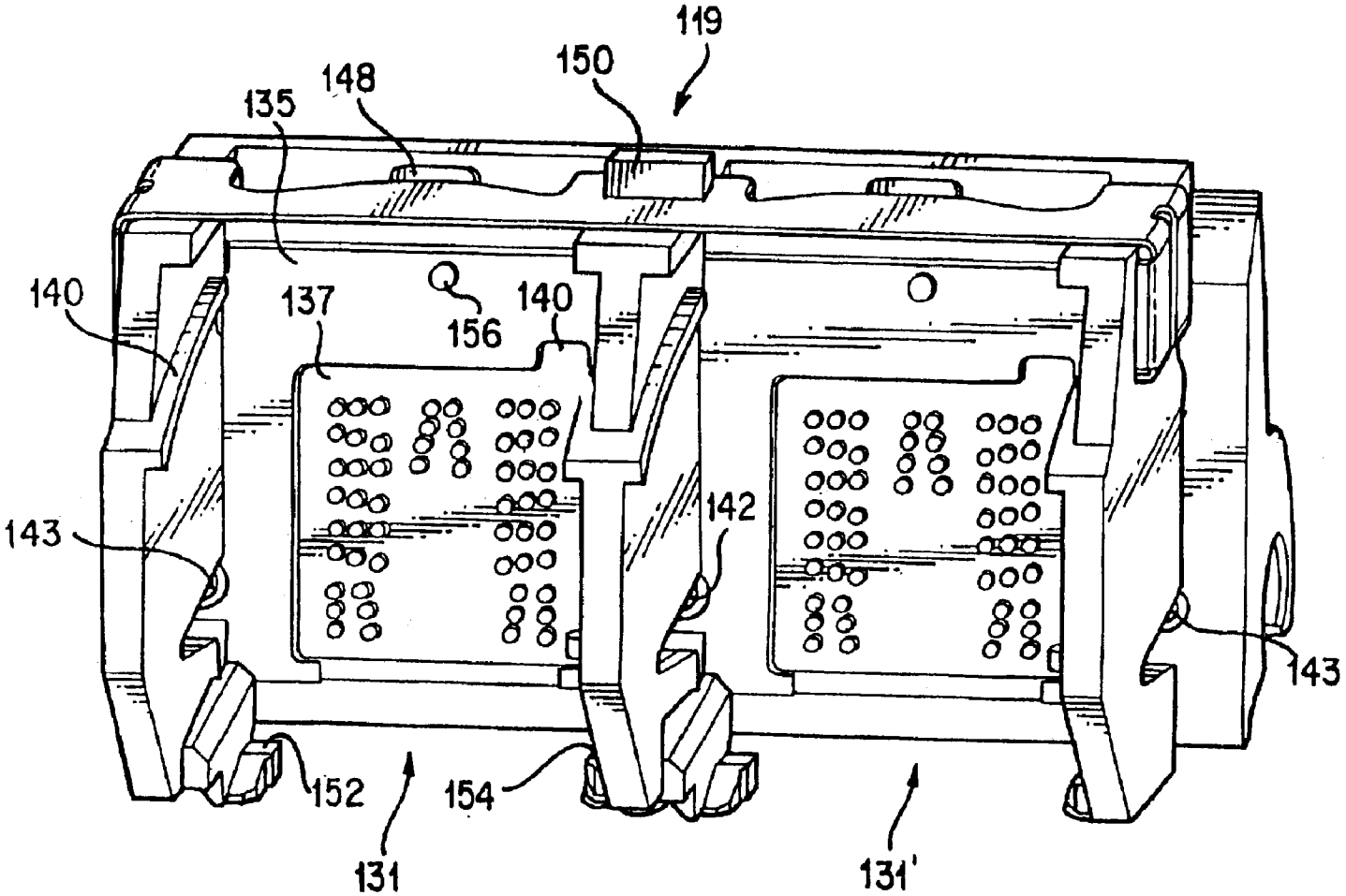

Referring to FIGS. 9, 12, and 13, the carriage 119 also includes two chutes 131 that each receive, hold, and align the ink-jet print cartridge 11 as illustrated in FIG. 9. Both chutes are constructed and operate in the same manner; so for brevity only the left chute will be described. The chute 131 has a left side wall 133, a right side wall 134, and a rear or end wall 135. Located on the rear wall 135 of the chute is a dimpled contact pad 137. The contact pad has an elastomeric backing and contains electrical contacts that are urged against corresponding contacts on the flex circuit 33, FIG. 2, on the print cartridge 11. In this manner the printer 114 makes electrical contact with the print cartridge and supplies electrical energy to the firing resistors during printing.

Dimpled contact pads for thermal ink-jet print cartridges and carriages are disclosed in U.S. Pat. No. 4,706,097 entitled "Near-Linear Spring Connect Structure for Flexible Interconnect Circuits" by Harmon issued 10 Nov. 1987.

Figure 10:
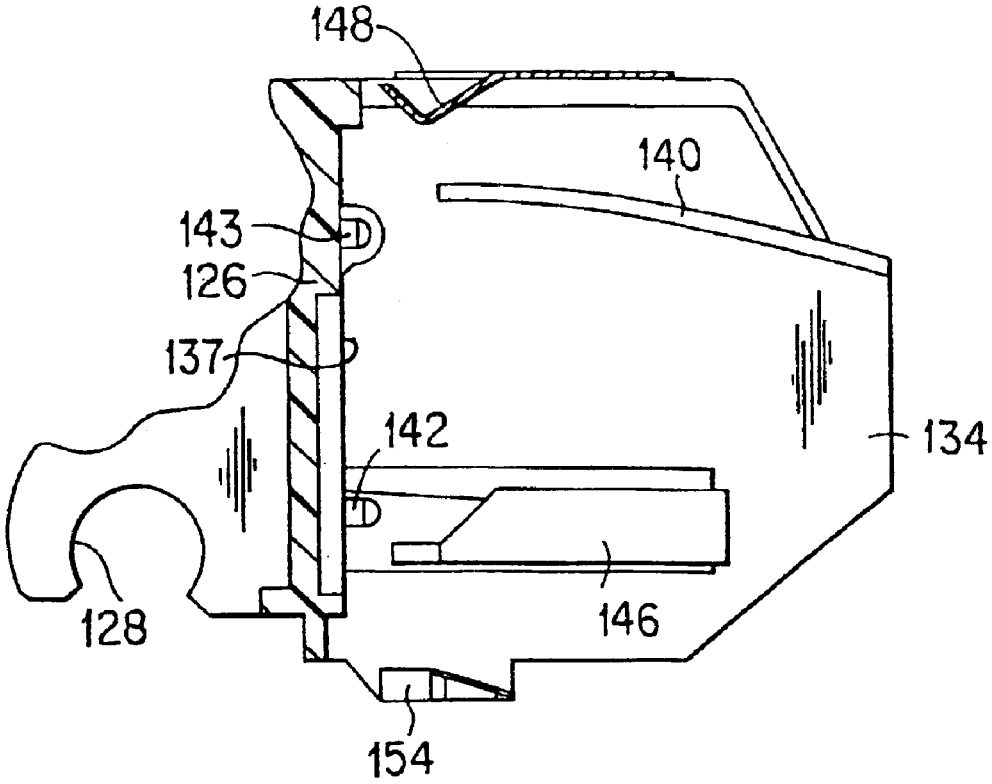
FIG. 10 is a side elevational view, in section, taken along line 10—10 of the carriage of FIG. 9, with the print cartridges removed.

The dimpled contact pads 137, FIGS. 10, 12, and 13, are held in place against the rear wall 135 of each chute 131 by six pins 142, 143 located on the carriage base 126. Pin 142 locates the dimpled contact pad left and right and vertically in the carriage 119. The other five pins prevent the contact pad from rotating about the center pin 142 and inducing any stress in the contact pad.

Referring to FIGS. 10, 12, and 13, located on each side wall 133, 134, of the chute 131 is a guide rail 140. The guide rails are the guiding feature for installing and removing print cartridges from the printer 114. Referring to FIG. 10, in particular, each guide rail is generally horizontal, curved, arcuate, and inclined slightly upward in the positive "Y" direction as illustrated in FIG. 9. The guide rails 140 engage the bottom of the lips 29, FIGS. 2 and 3, located on the sidewalls 25, 26 of the print cartridge 11, FIG. 2.

Figure 20:
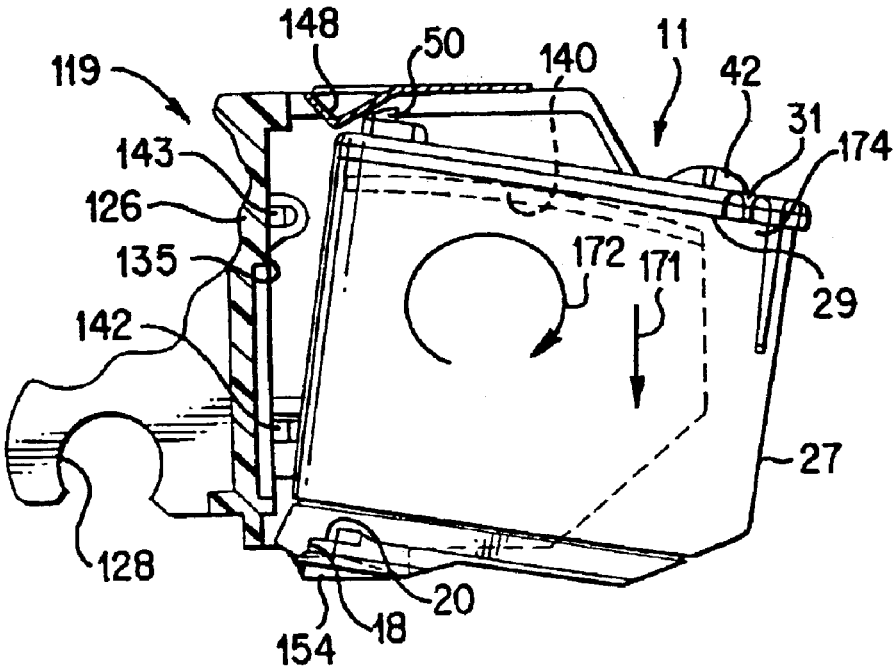

Further, the guide rails 140 in the chutes 131, FIGS. 12 and 13 serve many functions. First, the rails act as a target for the user when initially installing a print cartridge. They aid in locating the print cartridge 11 in the carriage 119, FIG. 1 which is only partially visible to the user. Second, once the print cartridge is resting on the guide rails and the print cartridge is pushed horizontally forward by the user, the rails guide the print cartridge up and over the primary and secondary carriage datums 152, 154, FIGS. 12, 13, and 14, described in detail below. Third, when a print cartridge is being unlatched from the carriage by the user, the guide rails limit the rotation or pitching of the print cartridge as illustrated in FIG. 20 so that it does not come tumbling out of the printer.

Referring to FIGS. 10 and 12, located in the right side wall 134 of each chute 131 is a cantilever spring 146. The spring 146 has a major axis that is horizontal. The cantilever spring biases or urges the print cartridge horizontally in the negative "X" direction as illustrated in FIG. 9, against the primary datums 152, FIGS. 13 and 14, on the carriage as described in detail below.

Figure 11:
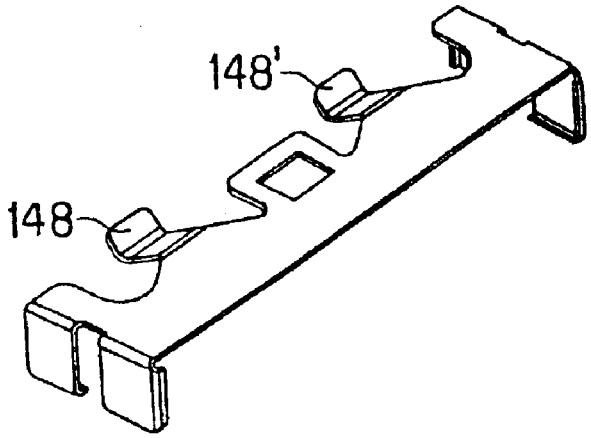
FIG. 11 is a perspective view of the latch spring of the carriage of FIG. 9.

In FIGS. 9, 10, 11, 12, and 13, reference numeral 148 indicates a latch spring having a horizontal tab pointing rearward in an ink-jet printer 114, FIG. 1, along the "Y" axis as illustrated in FIG. 9. The spring is directed in this manner to achieve the design objective of low printer height. The latch spring engages a latch 50, FIG. 2, molded into the lid 31 of the print cartridge as illustrated in FIG. 9. There is a latch spring for each chute 131, and they are fabricated from a single sheet metal part as illustrated in FIG. 11. The part is attached to features molded in the outside walls of the chutes 131. The part is also attached to an arresting finger 150 located on the center side wall of the carriage 119. The arresting finger has the shape of an "L" and prevents the mechanical strain from installing a print cartridge in one chute from affecting the print cartridge in the chute along side.

Referring to FIGS. 12, 13, and 14, located on the inside of the left side wall 133 at the bottom of the chute 131 are the primary datums 152 of the carriage 119. The corresponding datums 18, 20 on the print cartridge illustrated in FIG. 6 are urged against the primary datums 152 in the chute by the cantilever spring 152 in the right side wall 134 of the chute 131. Located on the inside of the right side wall 134 at the bottom of the chute 131 and directly opposite the primary datums 152 are the secondary datums 154 of the carriage 119. The secondary datums 154, FIGS. 12 and 14 engage the corresponding datums 18, 20 on the print cartridge illustrated in FIG. 3. There is a single tertiary datum 156 located in the rear wall 135 of the chute 131 above the dimpled contact pad 137. The tertiary datum locates the rotation or pitching of the print cartridge about the "X" axis to a known point.

Overall Discussion—Carriage and Print Cartridge Interface

Referring to the figures, with particular reference to FIGS. 15–21, the print cartridge 11 has a low profile body with mechanical interfacing features that enable installation of cartridge 11 into a receiving pocket or chute of a printing system carriage with a predominately horizontal motion.

The low profile aspect of the print cartridge body refers to the body having a major axis essentially aligned with the direction of installation 158 (or along the y-axis of FIG. 9). This allows the overall height (along z-axis of FIG. 9) of the print cartridge body to be minimized, thereby minimizing the overall height of the carriage 119 and hence printer 114. In particular, the height of the print cartridge is kept to less than about 47 millimeters. The low profile aspect also helps to minimize the width (along x-axis of FIG. 9) of the carriage 119 which reduces width of the overall printer 114.

Figure 15:
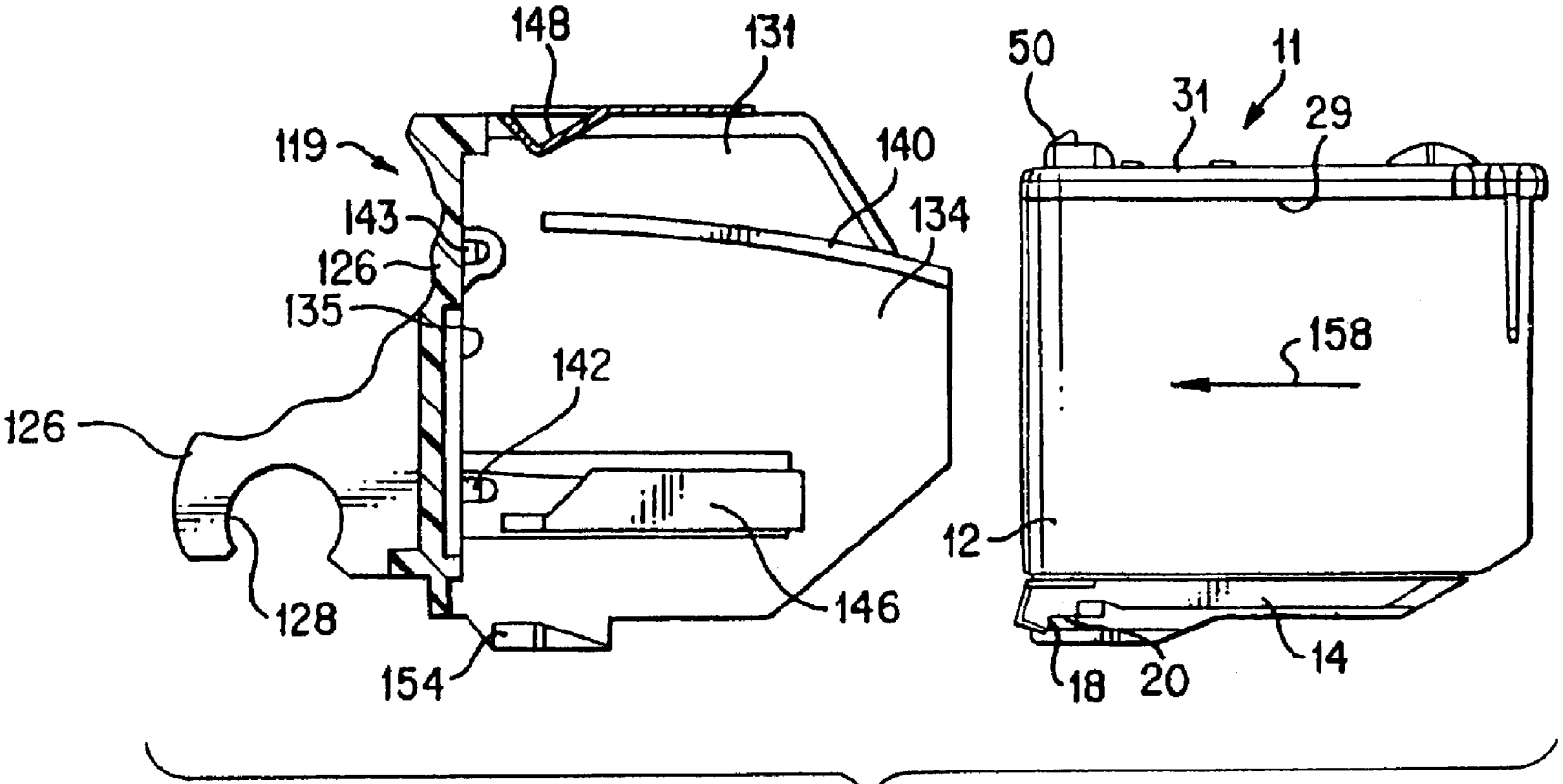
FIGS. 15–21, inclusive, are side elevational views, in section and partially cut away, taken along line 10—10 of the carriage of FIG. 9, illustrating the sequence of horizontally loading and unloading the ink-jet print cartridge of FIG. 2 from the carriage.

The mechanical interfacing features enable the print cartridge to be installed into chutes or receiving pockets 131 along a direction indicated by reference numeral 158 of FIG. 15. This enables "stackability" of printer 114—it allows other devices such as complementary electronic devices to be placed on top of printer 114. This in turn allows printing system 114 to be used in many more consumer applications than conventional printers or printing systems. The mechanical features include latch 50, datums 18 and 20, lips 29, and/or other features that engage corresponding features in receiving chutes 131. More details of the mechanical interfacing features will be discussed below in the sections titled "horizontal loading" and "unloading".

Horizontal Loading

Referring to FIG. 15, to load a print cartridge 11 in a carriage 119, the end user translates the print cartridge horizontally forward toward the carriage as indicated by the motion arrow 158. The guide rails 140 as illustrated in FIGS. 12 and 13 act as targets for the end user because visibility of the carriage is restricted by the housing for the printer.

Figure 16:
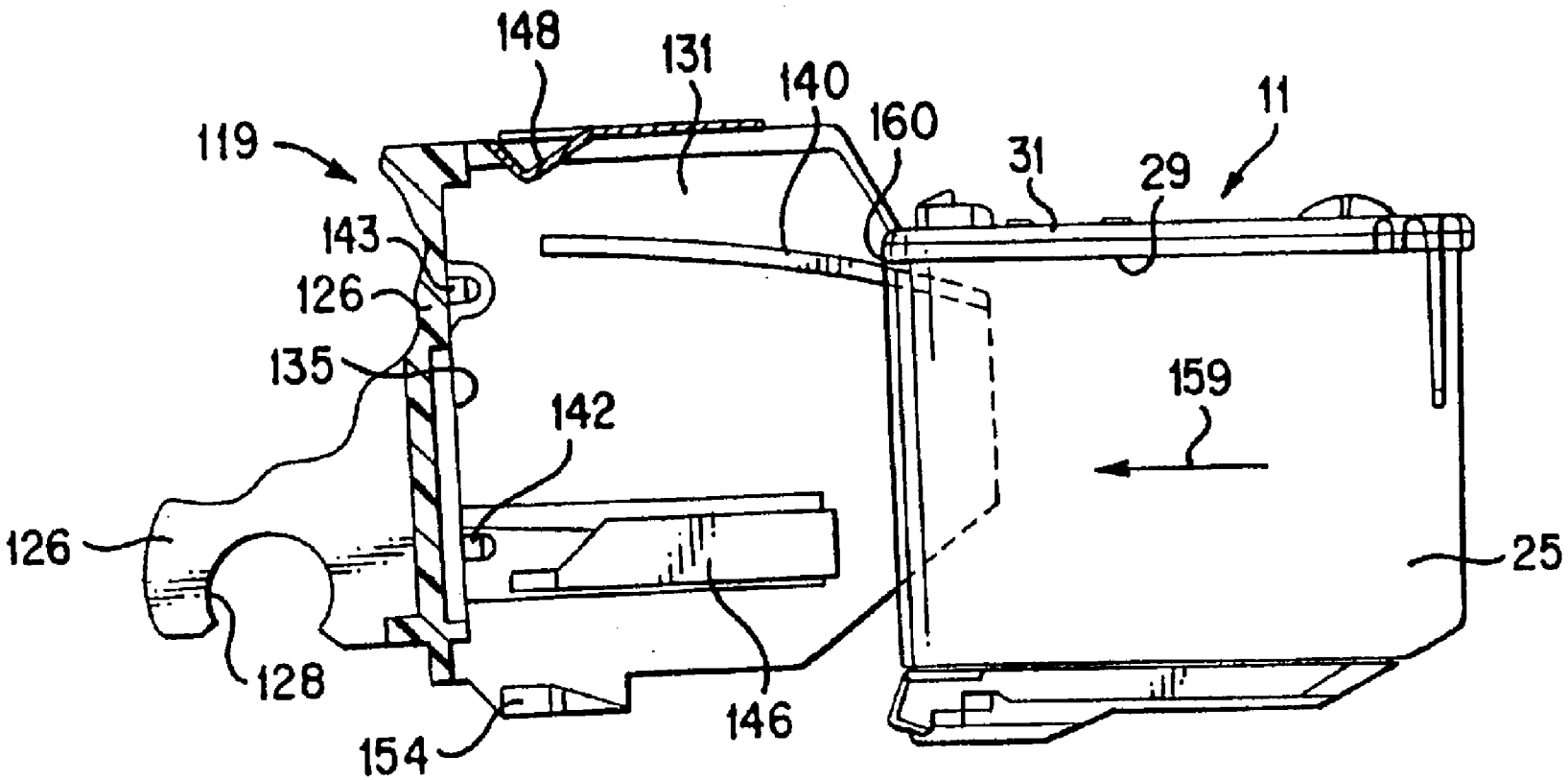

The print cartridge 11, FIG. 16 has a lip 29 in each of its side walls 25, 26. The underside of these lips first touch the guide rails 140 at the contact point 160, FIG. 16. The lips on each side are placed on the guide rails of the chute 131 by the end user and the guide rails thereafter support the cartridge vertically. At this point there is no contact between the vertical walls of the carriage 119 and vertical walls of the cartridge 11. The end user continues to horizontally translate the cartridge forward as indicated by the motion arrow 159.

Referring to the print cartridge 11 illustrated in FIG. 9, any positive or right hand rotation of the print cartridge about the "X" axis is defined as "pitching up" in accordance with the normal nautical and aeronautical convention of describing motion of an object. Likewise, any negative or left hand rotation of the print cartridge about the "X" axis is defined as "pitching down".

Each guide rail 140, referring to FIG. 10 in particular, is generally horizontal, curved, arcuate, and inclined slightly upward in the positive "Y" direction as illustrated in FIG. 9.

Figure 17:
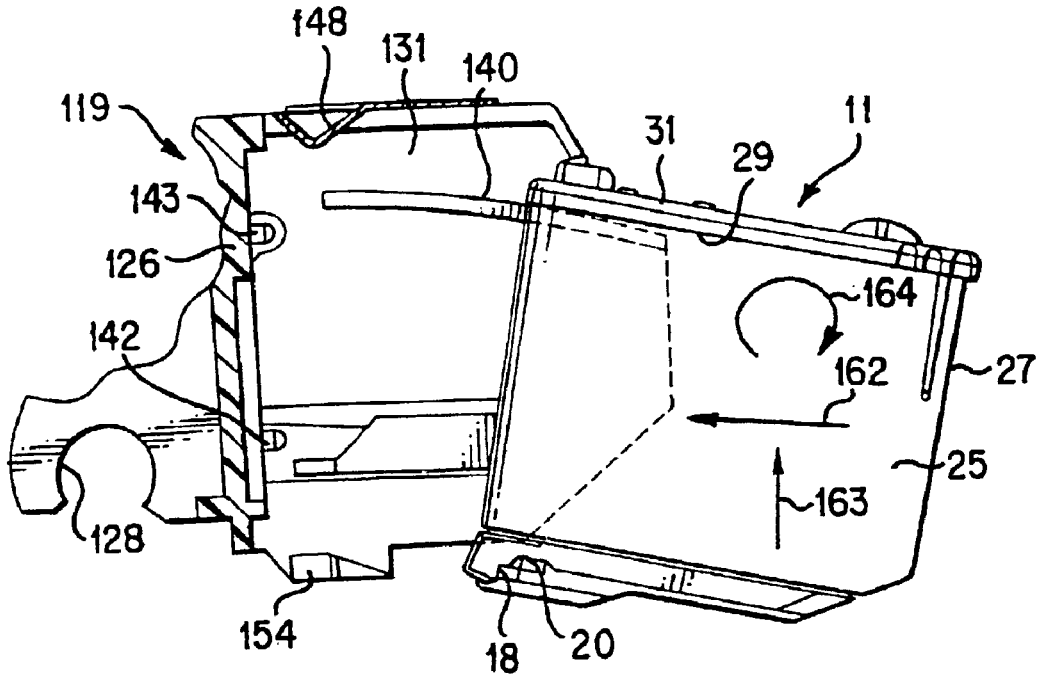

Referring to FIG. 17, the shape of the guide rails and the further horizontal translation of the print cartridge 11 by the end user indicated by the motion arrow 162 cause the print cartridge 11 to pitch up as indicated by the motion arrow 164 and also to translate vertically upward as indicated by the motion arrow 163. As the print cartridge 11 slides forward along the guide rails, the combination of these three motions, indicated by the motion arrows 162, 163, and 164, causes the datums 18, 20 on the print cartridge 11 to be brought up and over the primary and secondary datums 152, 154, on the bottom of the carriage 119.

The motion of the print cartridge 11 illustrated in FIG. 17 continues until the latch 50 on the top wall 31 of the print cartridge contacts the latch spring 148 on the carriage 119 at the contact point indicated by reference numeral 166. The latch spring causes the print cartridge to translate vertically downward as indicated by the motion arrow 168. Next the datums 18, 20 on the print cartridge 11 contact the primary and secondary datums 152, 154, on the carriage 119. At this point the datums are not yet seated, just in contact. The print cartridge 11 thereafter pitches downward as indicated by the motion arrow 167 due the contact between the datums and the shape of the latch 50 and latch spring 148.

Figure 18:
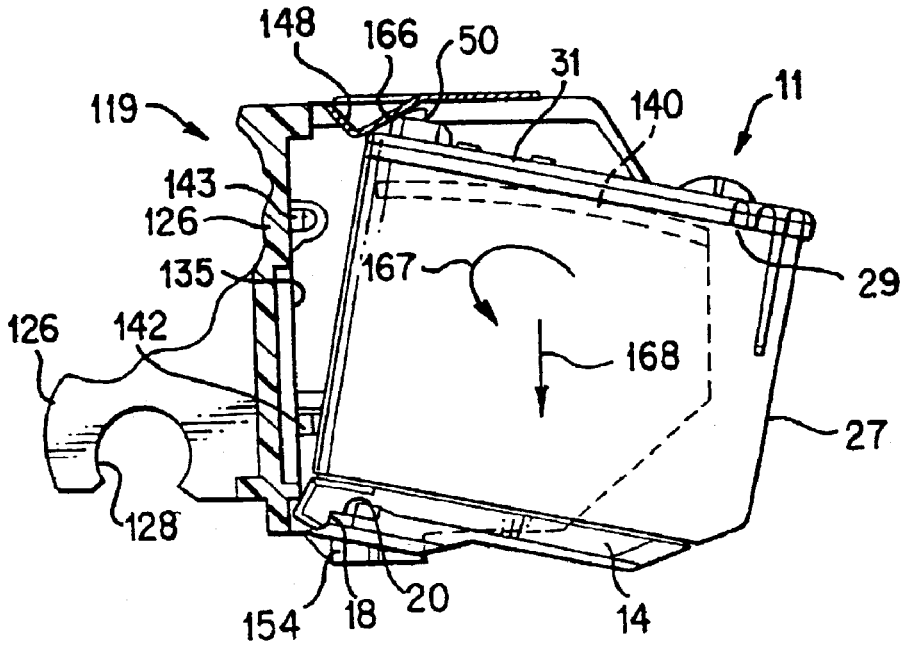
Figure 19:
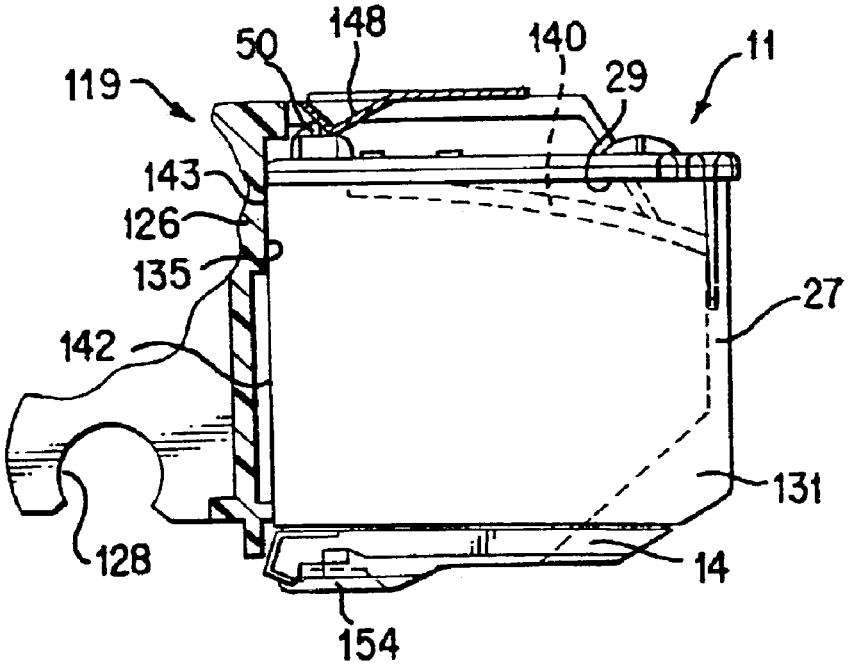

The motion of the print cartridge illustrated in FIG. 18 continues until the datums 18, 20 on the print cartridge 11 and the datums 152, 154, on the carriage 119 all snap into place, mating, and the latch spring 148 seats on the latch 50. Further downward pitching of the print cartridge is arrested by the rear wall 135 of the chute 131, the elastomer behind the dimpled contact pad 137, and the tertiary datum 156, FIG. 12. The print cartridge 11 is fully received in the carriage 119 at this point as illustrated in FIG. 19. It should be appreciated that the latch spring 148 continuously pushes the print cartridge out of the printer until this point of latching or mating is reached. This feature is binary and prevents false latching.

Unloading

Referring to FIG. 20, to unload a print cartridge 11 from a carriage 119, the end user applies a downward force to the top wall or lid 31 at the rear of the print cartridge. The print cartridge extends out from the carriage 119 as illustrated in FIG. 9, and this downward force may be applied to the button-like feature 42 on the lid. The downward force causes the downward motion indicated by the motion arrow 171, and the print cartridge pitches upward, as indicated by the motion a row 172, as the datums 18, 20 on the print cartridge 11 pivot around the primary and secondary datums 152, 154 on the carriage 119. The downward motion indicated by the motion arrow 171 and the upward pitching motion indicated by the motion arrow 172 continue until the latch 50 unlatches from the latch spring 148, as illustrated in FIG. 20. The guide rails 140 engage the lips 29 on the print cartridge 11 and limit the upward pitching motion 172 so that the print cartridge does not rotate or pop out of the printer.

It should be appreciated from a comparison of FIGS. 9, 19 and 20, that when a print cartridge is unlatched, the upper rear corner 174 of the unlatched print cartridge protrudes beyond the back wall 27 of the adjacent, latched print cartridge. The unlatched cartridge sits cocked compared to the latched print cartridge. This feature provides a visual indication of unlatching to the end user and also provides a gripping surface to the end user.

Figure 21:
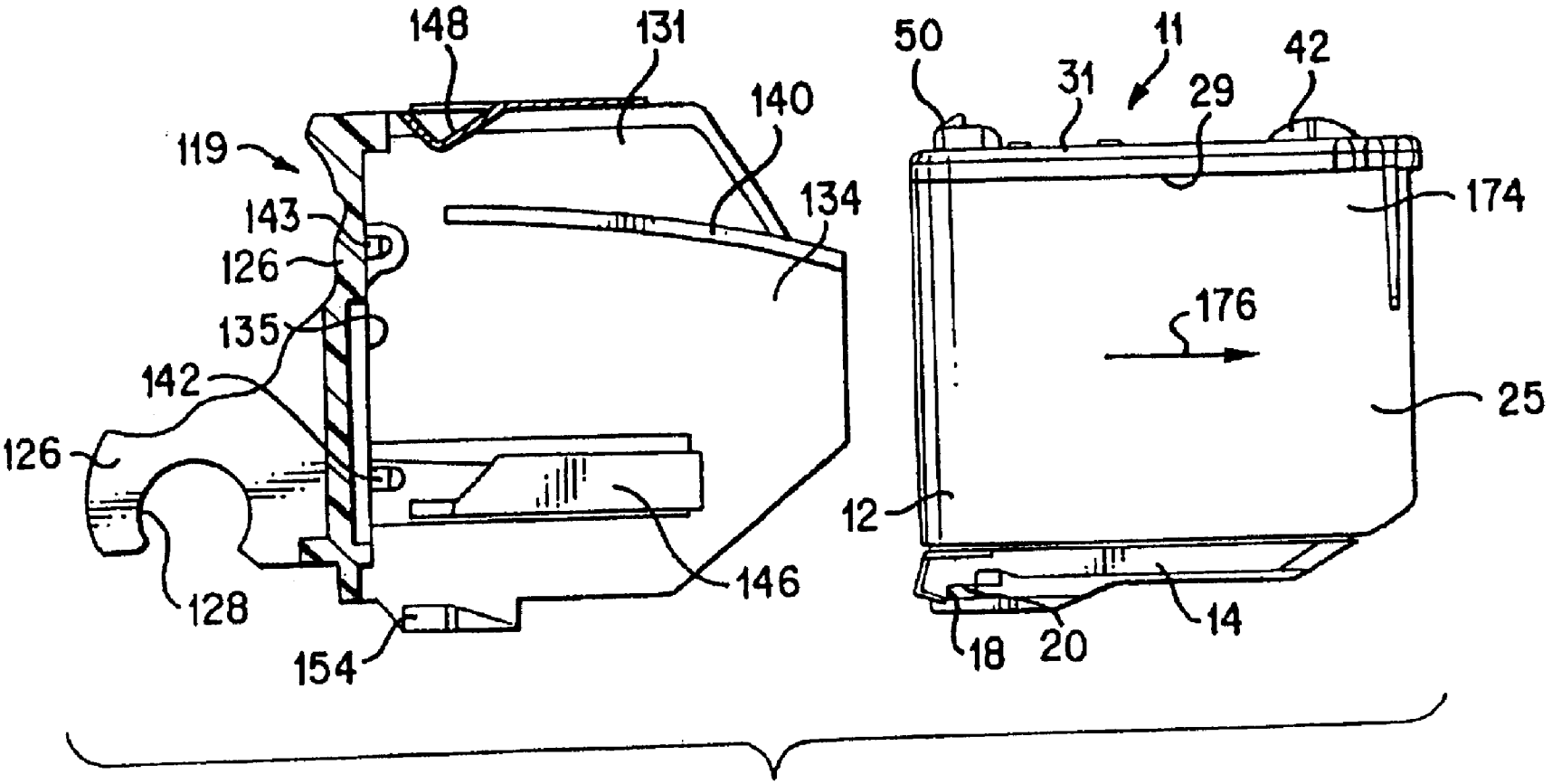

Referring to FIG. 21, after the print cartridge 119 is unlatched but still remains in the carriage 119, the end user grabs the gripping surface 174 and horizontally translates the print cartridge out of the carriage as indicated by the motion arrow 176.

Although specific embodiments of the invention have been described and illustrated, the invention is not to be limited to the specific forms or arrangement of parts so described and illustrated. The invention is limited only by the claims.

We claim:

1. Inkjet printing apparatus comprising:

a carriage having a plurality of generally horizontally extending chutes, wherein each chute has inner side walls which include a guide rail, a latch spring member attached across a top of each chute, a biasing spring on one of said inner side walls of each chute, and at least two print cartridges each having outer wall portions to facilitate removably mounting in said chutes, respectively, by initial translation of the print cartridge horizontally forward in a pitching up position and subsequent translation of the print cartridge horizontally forward in a pitching down position until the print cartridge is seated in the chute with the latch spring member engaged with a latch wall on top of the print cartridge, and wherein said guide rails and said biasing spring slidably contact said outer wall portions of the print cartridge during said initial translation and said subsequent translation of the print cartridge as well as when the print cartridge is seated in the chute.

2. The apparatus of claim 1 wherein said at least two print cartridges include a print cartridge having multiple ink compartments for holding different types of ink.

3. The apparatus of claim 1 wherein said at least two print cartridges include a print cartridge having a single ink compartment for holding a given type of ink.

4. The apparatus of claim 1 wherein said latch spring member is a unitary spring having an attachment to the carriage at a location between adjacent chutes to facilitate independent latching of said at least two print cartridges.

5. The apparatus of claim 1 wherein each chute has inner side walls with a pair of guide rails thereon.

6. The apparatus of claim 5 wherein each of said at least two print cartridges include lip extensions for engagement with said guide rails.

7. A print cartridge mountable into a generally horizontally extending chute on a carriage, comprising:

outer wall portions for engagement with guide rails in the chute during installation of the print cartridge as well as during printing by the print cartridge, a latch wall on top of the print cartridge for engagement with a latch spring on the carriage when the print cartridge is seated in printing position in the chute, additional outer wall portions for engagement with a biasing spring in the chute during installation of the print cartridge on the carriage as well as during printing by the print cartridge.

8. The print cartridge of claim 7 wherein said outer wall portions include a pair of lips extending from right and left outer walls, respectively, of the print cartridge for engagement with a pair of guide rails in the chute.

9. The print cartridge of claim 7 wherein said latch wall includes a well recessed in the top of the print cartridge.

10. The print cartridge of claim 7 which includes a gripping surface on top of the print cartridge.

11. The print cartridge of claim 7 which includes a gripping surface on outer walls of the print cartridge.

12. A printing apparatus, comprising:

a carriage including a latch spring and opposing side walls each having a guide rail formed thereon; and a print cartridge including a printhead and opposing side walls each having a lip extended therefrom, wherein said latch spring is adapted to bias said lip of one of said side walls of said print cartridge against said guide rail of one of said side walls of said carriage and bias said lip of the other of said side walls of said print cartridge against said guide rail of the other of said side walls of said carriage as said print cartridge is positioned in said carriage.

13. The apparatus of claim 12 wherein said latch spring of said carriage is supported between said opposing side walls thereof, and wherein said print cartridge includes a wall extended between said opposing side walls thereof, said wall having a latch formed thereon, wherein said latch spring is adapted to engage said latch when said print cartridge is positioned in said carriage.

14. The apparatus of claim 13 wherein said latch spring of said carriage is adapted to contact said latch of said print cartridge positioned in said carriage.

15. The apparatus of claim 12 wherein said carriage includes a cantilever spring projected from one of said side walls thereof, wherein said cantilever spring is adapted to contact and bias said print cartridge away from said one of said side walls of said carriage when said print cartridge is positioned in said carriage.

16. The apparatus of claim 12 wherein said print cartridge is positioned in said carriage with a motion including a horizontal component.

17. The apparatus of claim 16 wherein said motion further includes a first rotational component.

18. The apparatus of claim 17 wherein said motion further includes a first vertical component.

19. The apparatus of claim 18 wherein said motion further includes a second vertical component opposite the first vertical component.

20. The apparatus of claim 19 wherein said motion further includes a second rotational component opposite the first rotational component.

21. A printing apparatus, comprising:

a carriage including opposing side walls each having a guide rail formed thereon; and a print cartridge including opposing side walls each having a lip extended therefrom, wherein said lip of one of said side walls of said print cartridge is adapted to contact and slide along said guide rail of one of said side walls of said carriage and said lip of the other of said side walls of said print cartridge is adapted to contact and slide along said guide rail of the other of said side walls of said carriage as said print cartridge is positioned in said carriage, wherein said carriage includes a latch spring supported between said opposing side walls thereof, and wherein said print cartridge includes a wall extended between said opposing side walls thereof, said wall having a latch formed thereon, wherein said latch spring of said carriage is adapted to contact said latch of said print cartridge and bias said lip of said one of said side walls of said print cartridge against said guide rail of said one of said side walls of said carriage arid bias said lip of said other of said side walls of said print cartridge against said guide rail of said other of said side walls of said carriage as said print cartridge is positioned in said carriage, and wherein said latch spring is adapted to engage said latch when said print cartridge is positioned in said carriage.

* * * * *

UNITED STATES PATENT AND TRADEMARK OFFICE

CERTIFICATE OF CORRECTION

PATENT NO. : 6,948,798 B2
APPLICATION NO. : 10/263138
DATED : September 27, 2005
INVENTOR(S) : Daniel S. Kline et al.

It is certified that error appears in the above-identified patent and that said Letters Patent is hereby corrected as shown below:

IN THE CLAIMS

Column 11, Line 21, after “cartridge” insert --as said print cartridge is--

Column 12, Line 27, delete “arid” and insert therefor --and--

Signed and Sealed this

Twenty-fourth Day of June, 2008

JON W. DUDAS
*Director of the United States Patent and Trademark Office*